US011236761B2

(12) United States Patent
Hayashi et al.

(10) Patent No.: US 11,236,761 B2
(45) Date of Patent: Feb. 1, 2022

(54) COMPRESSOR MODULE

(71) Applicant: MITSUBISHI HEAVY INDUSTRIES COMPRESSOR CORPORATION, Tokyo (JP)

(72) Inventors: Masahiro Hayashi, Hiroshima (JP); Masayoshi Kikuchi, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 169 days.

(21) Appl. No.: 16/091,181

(22) PCT Filed: Jun. 10, 2016

(86) PCT No.: PCT/JP2016/067356
§ 371 (c)(1),
(2) Date: Oct. 4, 2018

(87) PCT Pub. No.: WO2017/212637
PCT Pub. Date: Dec. 14, 2017

(65) Prior Publication Data
US 2019/0162202 A1 May 30, 2019

(51) Int. Cl.
*F04D 29/40* (2006.01)
*F04B 39/06* (2006.01)
(Continued)

(52) U.S. Cl.
CPC ..... *F04D 29/403* (2013.01); *F04B 39/02* (2013.01); *F04B 39/06* (2013.01); *F04B 39/121* (2013.01);
(Continued)

(58) Field of Classification Search
CPC ..... F04D 13/00; F04D 13/02; F04D 13/06; F04D 13/16; F04D 17/08; F04D 17/10;
(Continued)

(56) References Cited

U.S. PATENT DOCUMENTS 3,176,913 A * 4/1965 Karl ..... F25B 43/02 418/85
4,501,973 A 2/1985 Fenemore et al.
(Continued)

FOREIGN PATENT DOCUMENTS

JP S55-17920 U 2/1980
JP S5517920 U * 2/1980 ..... F04B 39/06
(Continued)

OTHER PUBLICATIONS

International Search Report issued in PCT/JP2016/067356, dated Aug. 30, 2016 (4 pages).
(Continued)

*Primary Examiner* — Charles G Freay
*Assistant Examiner* — Chirag Jariwala
(74) *Attorney, Agent, or Firm* — Osha Bergman Watanabe & Burton LLP

(57) ABSTRACT

A compressor module includes: a driver having an output shaft which is rotationally driven around an axis; a compressor which is disposed side by side in an axial direction in which the axis extends with respect to the driver, and to which rotation of the output shaft is transmitted; a base plate which supports the driver and the compressor from below in a vertical direction; and a storage tank disposed below the base plate and having a tubular shape that extends in a direction including the axial direction, the storage tank being configured to store lubricating oil for the driver and the compressor.

4 Claims, 3 Drawing Sheets

(51) Int. Cl.

| | |
|---|---|
| ***F04B 39/02*** | (2006.01) |
| ***F04B 41/00*** | (2006.01) |
| ***F04B 39/12*** | (2006.01) |
| ***F04D 25/02*** | (2006.01) |
| ***F04D 17/10*** | (2006.01) |
| ***F04D 17/08*** | (2006.01) |
| ***F04D 25/06*** | (2006.01) |
| ***F04D 29/063*** | (2006.01) |
| ***F04D 29/58*** | (2006.01) |

(52) U.S. Cl.
CPC ..... *F04B 41/00* (2013.01); *F04D 17/08* (2013.01); *F04D 17/10* (2013.01); *F04D 25/02* (2013.01); *F04D 25/06* (2013.01); *F04D 29/063* (2013.01); *F04D 29/584* (2013.01)

(58) Field of Classification Search
CPC ..... F04D 25/00; F04D 25/02; F04D 25/06; F04D 25/0686; F04D 29/00; F04D 29/002; F04D 29/02; F04D 29/026; F04D 29/06; F04D 29/063; F04D 29/40; F04D 29/403; F04D 29/58; F04D 29/582; F04D 29/584; F04D 29/60; F04D 29/601; F04D 29/624; F04D 29/42; F04D 29/4206; F04D 29/021; F04D 29/025; F04B 39/02; F04B 39/06; F04B 39/121; F04B 41/00; Y10T 137/86035
USPC ..... 417/423.1, 423.14, 410.3, 410.4, 313, 417/234; 184/6.16
See application file for complete search history.

(56) References Cited

U.S. PATENT DOCUMENTS

| | | | | |
|---|---|---|---|---|
| 5,207,291 | A * | 5/1993 | Mezzedimi | F04D 29/104 184/6.16 |
| 7,975,505 | B2 * | 7/2011 | Struck | F02C 7/36 62/401 |
| 8,733,726 | B2 | 5/2014 | Maier | |
| 9,506,462 | B2 * | 11/2016 | Oba | F04B 39/06 |
| 9,828,980 | B2 * | 11/2017 | Maier | F04B 39/14 |
| 2006/0054216 | A1 | 3/2006 | Inoue | |
| 2012/0034511 | A1 | 2/2012 | Kitamura | |
| 2014/0202656 | A1 | 7/2014 | Maier | |
| 2015/0330409 | A1 * | 11/2015 | Mistry | F04C 29/04 417/53 |
| 2018/0187696 | A1 * | 7/2018 | Bigi | F04D 29/4206 |

FOREIGN PATENT DOCUMENTS

| | | | | |
|---|---|---|---|---|
| JP | 10-0339268 | A | 12/1998 | |
| JP | 2006077909 | A | 3/2006 | |
| JP | 2012038576 | A | 2/2012 | |
| JP | 201360882 | A | 4/2013 | |
| JP | 2012107754 | A * | 7/2013 | F01D 25/18 |

OTHER PUBLICATIONS

Written Opinion of the International Searching Authority issued in PCT/JP2016/067356, dated Aug. 30, 2016 (9 pages).

* cited by examiner

COMPRESSOR MODULE

TECHNICAL FIELD

The present invention relates to a compressor module.

BACKGROUND ART

A compressor module in which a compressor for compressing air or gas and a (driver), such as a motor or a turbine are installed on a base plate, is used for maritime facilities such as a ship. In the compressor module, a storage tank for collecting lubricating oil used in the compressor or the driver is also integrally provided.

For example, Patent Document 1 describes a turbo compressor in which a motor and a plurality of compressors are integrated. In the turbo compressor, a lubricating oil storage tank is provided below a gear case that connects motor and compressor to each other.

Incidentally, a piping for collecting lubricating oil used in compressor and driver is connected to a storage tank. In order to allow the lubricating oil to flow from the compressor and the driver to the storage tank, it is necessary to dispose the piping with a gradient so as to let the oil go down toward the storage tank.

CITATION LIST

Patent Literature

[Patent Document 1] Japanese Unexamined Patent Application, First Publication No. 2013-60882

SUMMARY OF INVENTION

Technical Problem

However, in a case where the storage tank is disposed below a gear case that connects the motor and the compressor to each other as described in Patent Document 1, the distance from the compressor and the driver to the storage tank increases. Therefore, the length of the piping that connects the compressor or the to the storage tank becomes long. As a result, it is necessary to provide a large space in order to ensure a sufficient gradient for flowing the lubricating oil and dispose the piping. The increase of piping space results in the increase of the compressor module size. Therefore, there is a demand for shortening the piping to reduce the space of the compressor module.

The present invention provides a compressor module which can achieve space saving condition.

Solution to Problem

According to a first aspect of the present invention, there is provided a compressor module including: a driver having an output shaft which is rotationally driven around an axis; a compressor which is disposed side by side in an axial direction in which the axis extends with respect to the driver, and to which rotation of the output shaft is transmitted; a base plate which supports the driver and the compressor from below in a vertical direction; and a storage tank disposed below the base plate and having a tubular shape that extends in a direction including the axial direction, the storage tank being configured to store lubricating oil for the driver and the compressor, in which the storage tank is fixed to the base plate so as to extend from a position at which the driver and at least a part of the storage tank overlap each other to a position at which the compressor and at least a part of the storage tank overlap each other when viewed from above in the vertical direction.

With the configuration, the storage tank can be disposed such that the driver and at least a part of the storage tank overlap each other in the vertical direction with the base plate interposed therebetween with respect to the compressor. Therefore, it is possible to extend a piping downward in the vertical direction from the driver and the compressor and to connect the driver and the compressor to the storage tank. As a result, it is possible to prevent the piping from extending in a direction other than the vertical direction when providing the piping connected to the storage tank. Accordingly, it is possible to reduce the space required for installing the piping.

In the compressor module according to a second aspect of the present invention, in the first aspect, the base plate may include a base plate body which widens in the axial direction, and a plurality of beam portions which have a shape of a plate that widens in a direction intersecting the axial direction below the base plate body, and are provided separately from each other in the axial direction, and the storage tank may be fixed to the beam portion.

With the configuration, the tubular storage tank can be used as a strength member of the base plate. As a result, it is possible to improve the rigidity of the base plate against deformation in a direction intersecting with the axial direction.

In the compressor module according to a third aspect of the present invention, in the first or second aspect, an outer circumferential surface of the storage tank may be formed of the same material as the base plate, and an inner circumferential surface of the storage tank may be formed of a material having a higher corrosion resistance than that of the outer circumferential surface.

With the configuration, it is possible to easily weld the base plate and the storage tank and the welding strength of the welded part can be improved. Accordingly, it is possible to suppress corrosion by the lubricating oil inside the tank. As a result, it is possible to firmly fix the storage tank to the base plate while suppressing corrosion by the lubricating oil.

In the compressor module according to a fourth aspect of the present invention, in any one of the first to the third aspects, a cooling portion fixed below the base plate, and having a tubular shape that extends in parallel to the storage tank, the cooling portion being configured to cool a working fluid compressed by the compressor, may be further provided.

With the configuration, the cooling portion can be used as a strength member of the base plate. Therefore, the rigidity of the base plate can further be improved.

In the compressor module according to a fifth aspect of the present invention, in any one of the first to the fourth aspects, the storage tank may extend so as to overlap the entire region in the axial direction of the driver and the compressor when viewed from above in the vertical direction.

With the configuration, regardless of where the piping is connected to the driver and the compressor, the length of the piping connected to the storage tank can be shortened.

Advantageous Effects of Invention

According to the present invention, space saving can be achieved.

DESCRIPTION OF EMBODIMENTS

First Embodiment

Hereinafter, a compressor module 1 of the present invention will be described with reference to the drawings.

Figure 1:
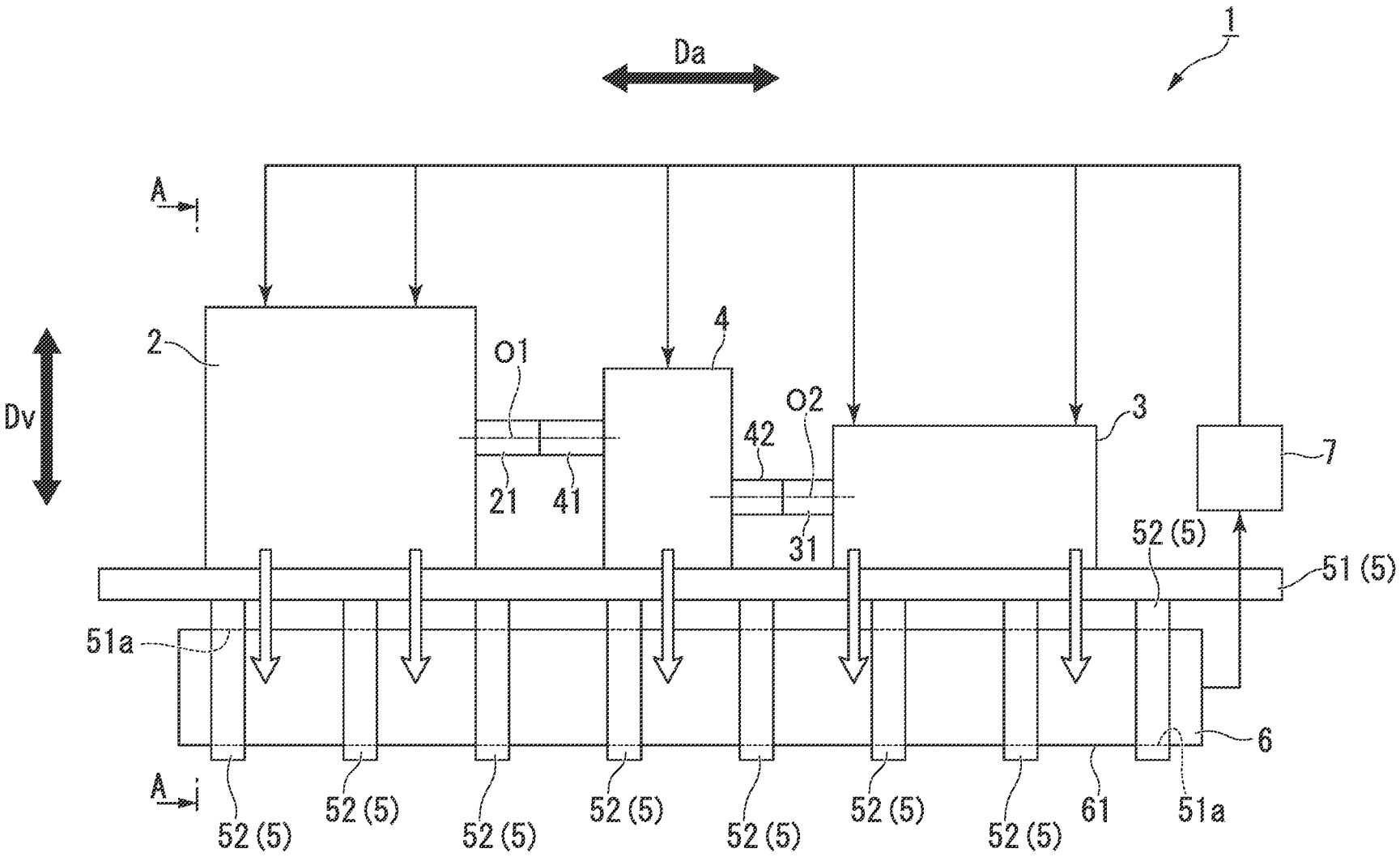
FIG. 1 is an outline showing a side view of a compressor module according to the first embodiment of the present invention from direction intersecting the axial direction.

As shown in FIG. 1, the compressor module 1 includes a driver 2, a compressor 3, a transmission 4, a base plate 5, a storage tank 6, and a lubricating oil supply portion 7.

The driver 2 is connected to the compressor 3 via the transmission 4. The driver 2 drives the compressor 3. The driver 2 has an output shaft 21 which is rotationally driven. The driver 2 of the present embodiment is an electric motor. The driver 2 always drives the output shaft 21 at a constant speed. The output shaft 21 is rotationally driven around a first axis (axis) O1. The output shaft 21 has a columnar shape with the first axis O1 as the center.

In addition, in the present embodiment, a direction orthogonal to a vertical direction Dv and a direction in which the first axis O1 extends is referred to as an axial direction Da. A direction orthogonal to the axial direction Da and the vertical direction Dv is referred to as a width direction Dw.

The compressor 3 is disposed side by side at intervals in the axial direction Da with respect to the driver 2. In the compressor 3, the rotation of the output shaft 21 is transmitted via the transmission 4. The compressor 3 of the present embodiment is, for example, a multi-stage centrifugal compressor. The compressor 3 has a rotor 31 connected to the transmission 4. The rotor 31 is rotated around a second axis O2. The rotor 31 has a columnar shape with the second axis O2 as the center. In addition, in the present embodiment, the second axis O2 is parallel to the first axis O1 but extends at a position shifted in the vertical direction Dv.

The compressor 3 is driven by the rotation of the output shaft 21 being transmitted to the rotor 31 via the transmission 4. The compressor 3 compresses a working fluid by the rotation of the rotor 31, and thus, a compressed fluid is generated. In addition, here, the application of the compressed fluid generated by the compressor 3 is not limited at all.

The transmission 4 transmits the rotation of the driver 2 to the compressor 3. The transmission 4 of the present embodiment is an accelerating machine that accelerates the rotation of the driver 2 by a plurality of gears. The transmission 4 is disposed to be interposed between the driver 2 and the compressor 3 in the axial direction Da. The transmission 4 of the present embodiment has a transmission input shaft 41 connected to the output shaft 21 and a transmission output shaft 42 connected to the rotor 31.

The transmission input shaft 41 is rotated around the first axis O1. The transmission input shaft 41 has a columnar shape with the first axis O1 as the center.

The transmission output shaft 42 is rotated around the second axis O2. The transmission output shaft 42 has a columnar shape with the second axis O2 as the center. In other words, the transmission output shaft 42 extends in parallel to the transmission input shaft 41 at a position shifted in the vertical direction Dv. The transmission output shaft 42 transmits the accelerated rotation input from the transmission input shaft 41 connected to the output shaft 21 to the connected rotor 31.

The base plate 5 supports the driver 2, the compressor 3, and the transmission 4 from below in the vertical direction Dv. In other words, the driver 2, the compressor 3, and the transmission 4 are installed on the base plate 5. The base plate 5 of the present embodiment has a base plate body 51 and a plurality of beam portions 52.

On the base plate body 51, the driver 2, the compressor 3, and the transmission 4 are fixed. The base plate body 51 widens in the axial direction Da and in the width direction Dw. The base plate body 51 of the present embodiment is a rectangular flat plate member elongated in the axial direction Da. When viewed from above in the vertical direction Dv, the base plate body 51 is formed with the size that overlaps the entire region of the driver 2, the compressor 3, and the transmission 4. The base plate body 51 is formed of a material with high rigidity that can be supported without deformation even when heavy loads, such as the driver 2, the compressor 3, and the transmission 4 are placed on. The base plate body 51 of the present embodiment is formed of carbon steel.

Figure 2:
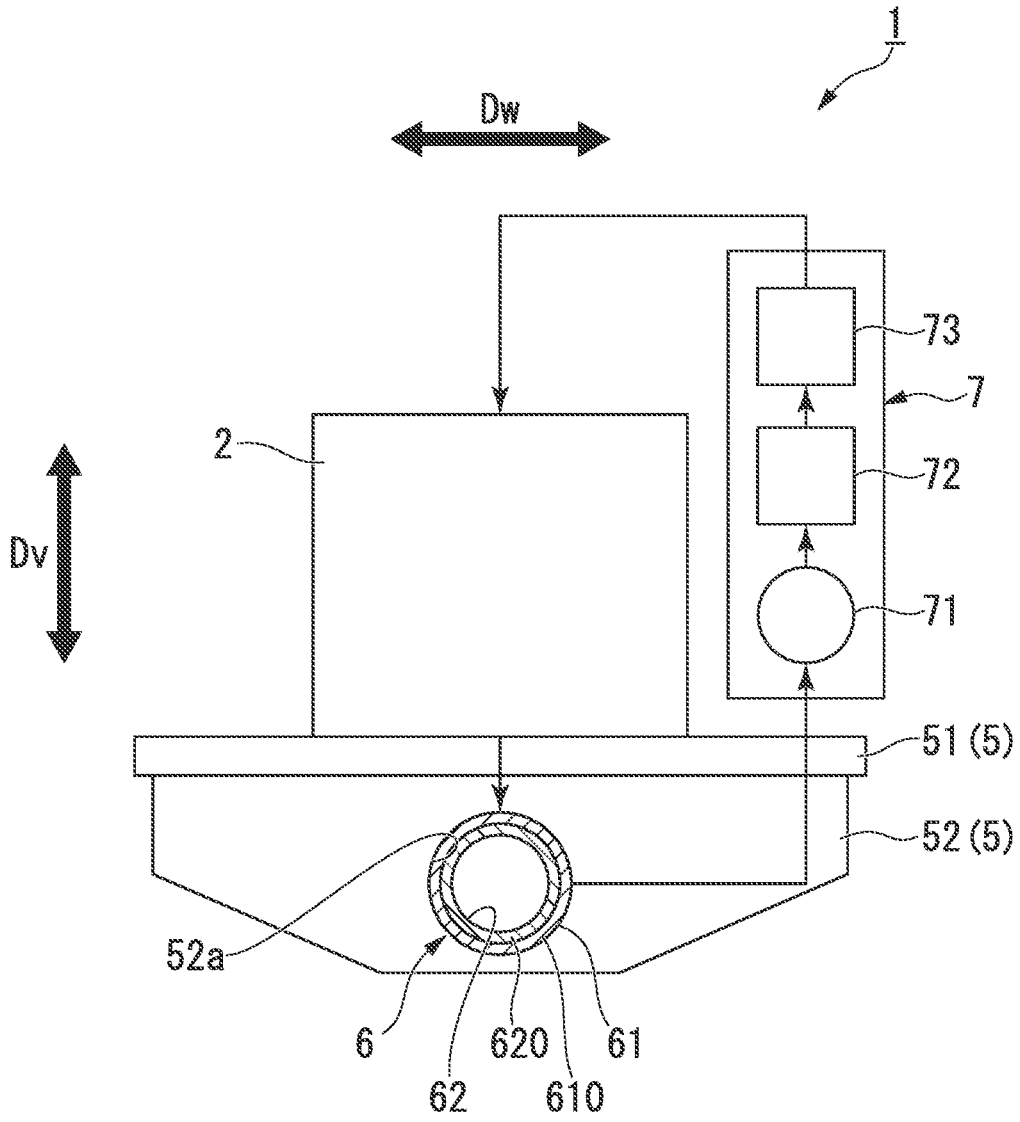
FIG. 2 is a sectional view taken along line A-A of FIG. 1 showing an outline of the compressor module according to the first embodiment of the present invention from the axial direction.

The beam portion 52 has a plate shape which widens in a direction intersecting with the axial direction Da from below the base plate body 51. The plurality of beam portions 52 are fixed to the base plate body 51 while being separated apart from each other in the axial direction Da. The plurality of beam portions 52 of the present embodiment are separated at equal intervals in the axial direction Da. As shown in FIG. 2, the beam portion 52 widens in the vertical direction Dv and in the width direction Dw so as to form a trapezoidal shape in which the lower part in the vertical direction Dv is short when viewed in the axial direction Da. A surface of the beam portion 52 facing upward in the vertical direction Dv is fixed to a surface of the base plate body 51 facing downward by welding or the like. A through-hole 52*a* which penetrates in the axial direction Da is formed at the center position of the beam portion 52 in the width direction Dw and in the vertical direction Dv. The beam portion 52 is formed of the same material as that of the base plate body 51. The beam portion 52 of the present embodiment is formed of carbon steel.

The storage tank 6 stores the lubricating oil used in the driver 2, the transmission 4, and the compressor 3. The lubricating oil is used in bearings (not shown) of each device. The storage tank 6 of the present embodiment is connected to each of the driver 2, the transmission 4, and the compressor 3 by a piping (not shown).

As shown in FIG. 1, the storage tank 6 has a tubular shape which extends in a direction including the axial direction Da. The storage tank 6 of the present embodiment has a bottomed cylindrical shape which extends in the axial direction Da. The storage tank 6 is fixed to a base plate 5 by being extend from a position at which the driver 2 and at least a part of the storage tank 6 overlap each other to a position at which the compressor 3 and at least a part of the storage tank 6 overlap each other in the axial direction Da when viewed from above in the vertical direction Dv. When viewed from above in the vertical direction Dv, the storage tank 6 extends so as to overlap the entire region in the axial direction Da of the driver 2, the transmission 4, and the compressor 3. In other words, when viewed from above in the vertical direction Dv, the storage tank 6 extends so as to overlap the position on the outermost in the axial direction Da of the driver 2 and the compressor 3. The storage tank 6 of the present embodiment has a length in the axial direction Da substantially same as the length of the base plate body 51.

The storage tank 6 is disposed below the base plate 5. The storage tank 6 of the present embodiment is fixed to the beam portion 52 in a state of being inserted into the through-hole 52*a*. In the storage tank 6, the outer circumferential surface 61 is welded to the beam portion 52.

In the storage tank 6, the outer circumferential surface 61 is formed of the same material as that of the beam portion 52. In the storage tank 6, the inner circumferential surface 62 is formed of a material with higher corrosion resistance than that of the outer circumferential surface 61. Specifically, as shown in FIG. 2, the storage tank 6 of the present embodiment is formed of two types of materials with a clad material in which two layers of a first layer 610 and a second layer 620 are laminated. Accordingly, the outer circumferential surface 61 of the storage tank 6 is formed by the first layer 610 made of carbon steel. In addition, the inner circumferential surface 62 of the storage tank 6 is formed by the second layer 620 made of stainless steel with higher corrosion resistance than that of the first layer 610.

The lubricating oil supply portion 7 supplies the lubricating oil from the storage tank 6 to the bearings of the driver 2, the transmission 4, and the compressor 3. The lubricating oil supply portion 7 is connected to a plurality of bearings, respectively. The lubricating oil supply portion 7 of the present embodiment has a feed pump 71, an oil cooler 72, and an oil filter 73 in the middle.

The feed pump 71 pumps the lubricating oil in the storage tank 6 toward the driver 2, the transmission 4, and the compressor 3. The oil cooler 72 cools the lubricating oil after the feed pump 71. The oil filter 73 removes foreign matters, such as dust after the oil cooler 72.

In the compressor module 1 as described above, it is possible to dispose the storage tank 6 so as to allow the tank overlapping with the driver 2, the transmission 4, and the compressor 3 in the vertical direction Dv with the base plate 5 interposed therebetween. It is possible to extend the piping immediately downward in the vertical direction Dv from the driver 2, the transmission 4, and the compressor 3, and to connect the driver 2, the transmission 4, and the compressor 3 to the storage tank 6. It is possible to provide the piping with a short length and ensure the gradient necessary for flowing the lubricating oil to the storage tank 6. In other words, it is possible to install the piping with the shortest length necessary for the vertical direction Dv without extending the piping in the axial direction Da or in the width direction Dw. Therefore, it is possible to prevent the piping from extending in the axial direction Da or in the width direction Dw other than the vertical direction Dv when providing the piping connected to the storage tank 6. Accordingly, it is possible to reduce the space required for piping installation. As a result, space saving of the compressor module can be achieved.

In particular, in a case where the compressor module 1 is installed in a maritime facility, such as a ship, it is necessary to maintain a large gradient to achieve stable flow of the lubricating oil even when a shake due to the wave occurs. Even in such a case, piping extended only in the vertical direction Dv without extending the piping in the axial direction Da or in the width direction Dw, it is possible to easily ensure the gradient.

In addition, even in a case where another device or the like is disposed on the base plate 5, since the positions in the vertical direction Dv overlap each other, the piping can be installed by setting the length of the axial direction Da or the width direction Dw to be the lowest limit. Therefore, it is unnecessary to bend piping in a complicated manner in various directions in order to avoid other equipment.

Therefore, it is possible to reduce the space of the piping, and it is possible to save the space of the entire compressor module 1. Accordingly, it is possible to reduce the size and weight of the entire compressor module 1.

Further, by making the storage tank 6 into a bottomed cylindrical shape which extends in the axial direction Da, even when an amount of lubricating oil to be stored increases by changing the specifications of the driver 2, the transmission 4, and the compressor 3, it is possible to cope with by simply extending the storage tank 6 without increasing the storage tank 6 in the vertical direction Dv. As a result, it is possible to suppress the size of the compressor module 1 as a whole in the vertical direction Dv from increasing.

In addition, when viewed from above in the vertical direction Dv, the storage tank 6 extends so as to overlap the entire region in the axial direction Da of the driver 2, the transmission 4, and the compressor 3, and thus, the driver 2, the transmission 4, and the compressor 3 overlap the storage tank 6 at any position in the axial direction Da. Therefore, similar to a case where the bearings are disposed separately from each other in the axial direction Da, even in a case where it is necessary to connect a plurality of pipings to one driver 2 or the compressor 3, it is possible to connect all of the pipings to the storage tank 6 with the shortest distance.

Further, by fixing the storage tank 6 in a state of being inserted into the through-hole 52*a* of the plurality of beam portions 52, the storage tank 6 having a bottomed cylindrical shape can be used as a strength member, such as a pillar that extends in the axial direction Da on the base plate 5. As a result, it is possible to improve the rigidity of the base plate 5 against deformation in a direction intersecting the axial direction Da.

In addition, since the outer circumferential surface 61 of the storage tank 6 is formed of the same carbon steel as the beam portion 52, the beam portion 52 and the storage tank 6 can be easily welded to each other. Therefore, the welding strength of the welded part can be improved. In addition, since the inner circumferential surface 62 of the storage tank 6 is formed of stainless steel with higher corrosion resistance than that of the outer circumferential surface 61, corrosion due to the lubricating oil stored therein can be suppressed. Therefore, it is possible to firmly fix the storage tank to the beam portion 52 while suppressing corrosion by the lubricating oil.

Second Embodiment

Next, a compressor module 1A of a second embodiment will be described with reference to FIG. 3.

In the second embodiment, the same configuration elements as those of the first embodiment will be denoted by the same reference numerals, and the detailed description thereof will be omitted. The compressor module 1A of the second embodiment is different from the first embodiment in the configuration of a gas cooler 8.

Figure 3:
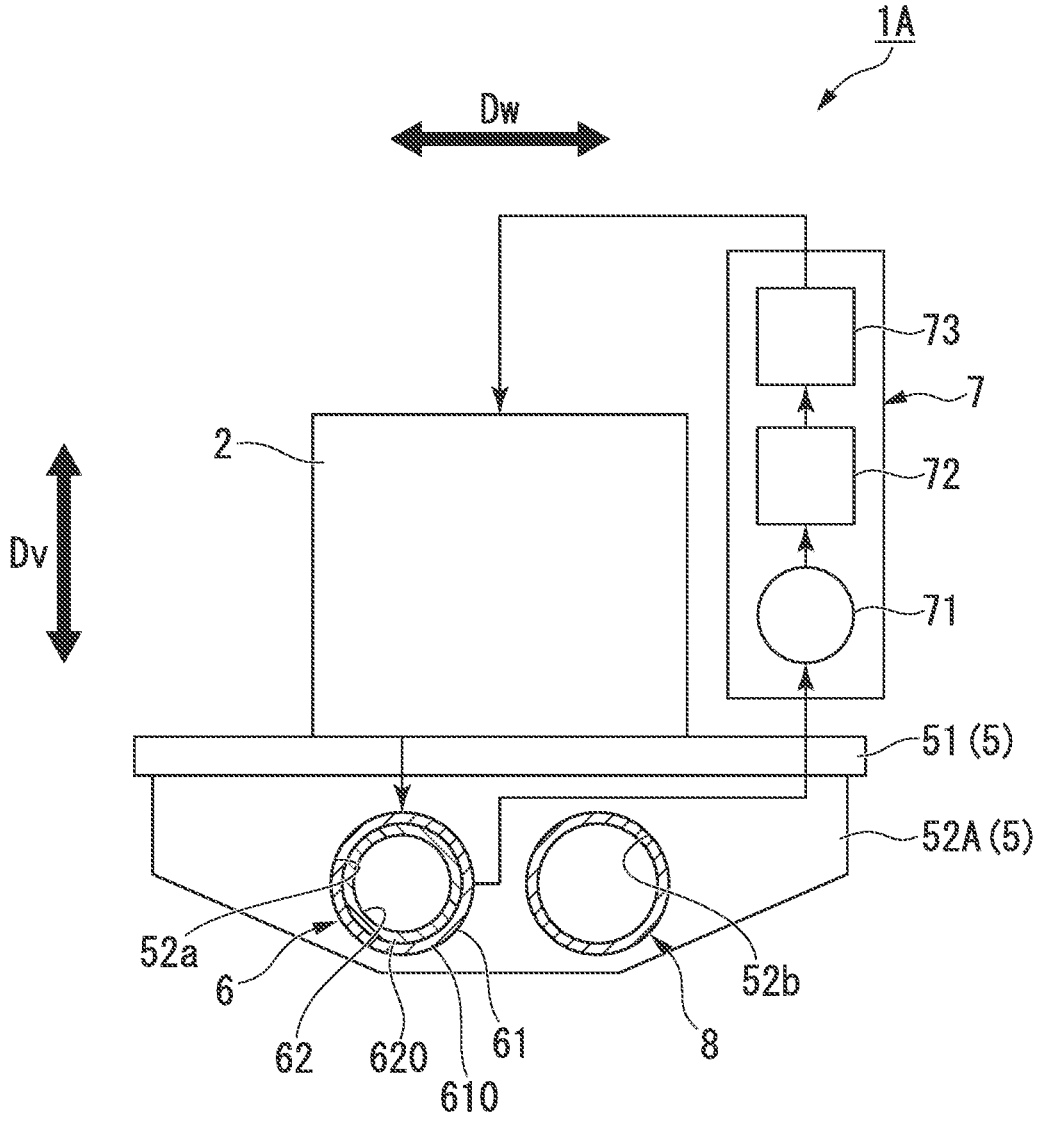
FIG. 3 is a sectional view taken along line A-A of FIG. 1 showing an outline of a compressor module according to a second embodiment of the present invention from the axial direction.

In other words, in the compressor module 1A of the second embodiment, as shown in FIG. 3, the gas cooler (cooling portion) 8 having a tubular shape which extends in parallel to the storage tank 6 is provided.

The gas cooler 8 cools the working fluid compressed by the compressor 3. The gas cooler 8 of the present embodiment has a bottomed cylindrical shape which extends in the axial direction Da. The gas cooler 8 is formed in parallel with the storage tank 6 when viewed from above in the vertical direction Dv. Similar to the storage tank 6, the gas cooler 8 extends in the vertical direction Dv from a position at which the driver 2 and at least a part of the gas cooler 8 overlap each other to a position at which the compressor 3 and at least a part of the gas cooler 8 overlap each other in the vertical direction Dv. When viewed from above in the vertical direction Dv, the gas cooler 8 extends so as to overlap the entire region in the axial direction Da of the driver 2, the transmission 4, and the compressor 3. In other words, when viewed from above in the vertical direction Dv, the gas cooler 8 extends so as to overlap the position on the outermost in the axial direction Da of the driver 2 and the compressor 3. The gas cooler 8 of the present embodiment has a length in the axial direction Da substantially same as the length of the storage tank 6.

The gas cooler 8 is connected below the base plate 5. The gas cooler 8 of the present embodiment is inserted through a second through-hole 52*b* formed in parallel in the width direction Dw with respect to the through-hole 52*a* through which the storage tank 6 of a beam portion 52A is inserted. The gas cooler 8 is fixed to the beam portion 52A by being inserted into the second through-hole 52*b*. In the gas cooler 8, the outer circumferential surface 61 is welded to the beam portion 52A.

The gas cooler 8 is formed of the same material as that of the beam portion 52A. The gas cooler 8 of the present embodiment is formed of carbon steel.

In the compressor module 1A, the gas cooler 8 is fixed by being inserted into the second through-hole 52*b* of the plurality of beam portions 52A, and thus, together with the storage tank 6, the gas cooler 8 can be used as a strength member, such as a pillar that extends in the axial direction Da on the base plate 5. As a result, it is possible to further improve the rigidity of the base plate 5 against deformation in a direction intersecting the axial direction Da.

Above, although the embodiments of the present invention have been described in detail with reference to the drawings, the respective configurations and combinations thereof in the respective embodiments are merely examples, and additions, omissions, substitutions, and other changes of configurations are possible within the scope not departing from the gist of the present invention. In addition, the present invention is not limited by the embodiments, and is limited only by the claims.

In addition, the driver 2 is not limited to an electric motor as in the present embodiment, but may be any device as long as the device can drive the compressor 3. The driver 2 may be, for example, a steam turbine or a gas turbine.

Further, the direction including the axial direction Da in which the storage tank 6 extends is not limited to the direction that matches the axial direction Da as in the present embodiment, but may be a direction including the component in the axial direction Da. Therefore, the direction including the axial direction Da may be, for example, a direction inclined with respect to the axial direction Da.

INDUSTRIAL APPLICABILITY

According to the compressor modules 1 and 1A described above, it is possible to reduce the space required for installing the piping and to save space.

REFERENCE SIGNS LIST

1, 1A COMPRESSOR MODULE
Da AXIAL DIRECTION
Dv VERTICAL DIRECTION
Dw WIDTH DIRECTION
2 DRIVER
O1 FIRST AXIS
21 OUTPUT SHAFT
3 COMPRESSOR
O2 SECOND AXIS
31 ROTOR
4 TRANSMISSION
41 TRANSMISSION INPUT SHAFT
42 TRANSMISSION OUTPUT SHAFT
5 BASE PLATE
51 BASE PLATE BODY
52, 52A BEAM PORTION
52*a* THROUGH-HOLE
6 STORAGE TANK
61 OUTER CIRCUMFERENTIAL SURFACE
62 INNER CIRCUMFERENTIAL SURFACE
610 FIRST LAYER
620 SECOND LAYER
7 LUBRICATING OIL SUPPLY PORTION
71 FEED PUMP
72 OIL COOLER
73 OIL FILTER
8 GAS COOLER
52*b* SECOND THROUGH-HOLE

What is claimed is:

1. A compressor module comprising:

a driver comprising an output shaft that is rotationally driven around an axis;

a compressor
that is disposed side by side with respect to the driver in an axial direction in which the axis extends, and to which rotation of the output shaft is transmitted;

a base plate that supports the driver and the compressor from below in a vertical direction;

a storage tank that is disposed below the base plate, that has a tubular shape that extends in a direction including the axial direction, and that stores lubricating oil for the driver and the compressor;

piping that extends only immediately downward in the vertical direction from the driver and the compressor and that connects to the storage tank; and a cooling portion that is fixed below the base plate, that has a tubular shape that extends in parallel to the storage tank, and cools a working fluid compressed by the compressor, wherein the piping is connected to the storage tank such that the piping spans a shortest length in the vertical direction between the storage tank and each of the driver and the compressor, wherein the piping causes the lubricating oil to flow into the storage tank, wherein the base plate comprises:

a base plate body that widens in the axial direction; and a plurality of beam portions that each have a shape of a plate that widens in a direction intersecting the axial direction below the base plate body and that are disposed separately from each other in the axial direction, wherein each of the plurality of beam portions has:

a first through-hole that penetrates each of the plurality of beam portions in the axial direction; and a second through-hole that penetrates each of the plurality of beam portions in the axial direction, wherein the storage tank is inserted into the first through-hole and fixed to each of the plurality of beam portions and extends from a position at which the driver overlaps with at least a first part of the storage tank when viewed from above in the vertical direction to a position at which the compressor overlaps with at least a second part of the storage tank when viewed from above in the vertical direction, and wherein the cooling portion is inserted into the second through-hole and fixed to each of the plurality of beam portions and extends from a position at which the driver overlaps with at least a first part of the cooling portion when viewed from above in the vertical direction to a position at which the compressor overlaps with at least a second part of the cooling portion when viewed from above in the vertical direction.

2. The compressor module according to claim 1, wherein the storage tank extends and overlaps an entire region of the driver and the compressor in the axial direction when viewed from above in the vertical direction.

3. The compressor module according to claim 1, wherein an outer circumferential surface of the storage tank is formed of a same material as the base plate, and an inner circumferential surface of the storage tank is formed of a material having a higher corrosion resistance than that of the outer circumferential surface.

4. The compressor module according to claim 3, wherein the storage tank extends and overlaps an entire region of the driver and the compressor in the axial direction when viewed from above in the vertical direction.

* * * * *